US005973645A

United States Patent [19]

Zigler et al.

[11] Patent Number: 5,973,645

[45] Date of Patent: Oct. 26, 1999

[54] SNAP-ON ANTENNA AND PROTECTIVE CONNECTOR MOUNTING FOR A HAND-HELD ELECTRONIC DEVICE

[75] Inventors: Robert A. Zigler, Marysville, Wash.; Kevin Arnal, Chanhassen, Minn.

[73] Assignee: Intermec IP Corporation, Beverly Hills, Calif.

[21] Appl. No.: 08/772,170

[22] Filed: Dec. 19, 1996

[51] Int. Cl.[6] ..... H01Q 1/24

[52] U.S. Cl. ..... 343/702; 343/715; 343/903; 343/906

[58] Field of Search ..... 343/702, 700 MS, 343/715, 903, 906; 439/916

[56] References Cited

U.S. PATENT DOCUMENTS

| | | | |
|---|---|---|---|
| 5,122,063 | 6/1992 | Cooper | 439/13 |
| 5,403,197 | 4/1995 | Ernst et al. | 343/906 |
| 5,440,315 | 8/1995 | Wright et al. | 343/702 |
| 5,555,459 | 9/1996 | Kraus et al. | 343/702 |
| 5,576,720 | 11/1996 | Gorenz, Jr. et al. | 343/702 |
| 5,579,023 | 11/1996 | Blaese | 343/906 |
| 5,635,943 | 6/1997 | Grunwell | 343/702 |

*Primary Examiner*—Don Wong
*Assistant Examiner*—Hoang Nguyen
*Attorney, Agent, or Firm*—Seed and Berry LLP

[57] ABSTRACT

A snap-on antenna and connector mounting assembly for a hand-held electronic device, such as a hand-held computer. The hand-held electronic device has a housing with a sidewall and a jack-receiving aperture therein, an antenna jack extending through the jack-receiving aperture, and a flexible bushing positioned in the jack-receiving aperture between the antenna jack and the sidewall. The bushing isolates the antenna jack from the sidewall, so the antenna jack is deflectable relative to the sidewall without being damaged. The snap-on antenna has a substantially rigid base having an interior area therein and having a housing-attachment portion with an aperture communicating with the interior area. A plug connector contained within the interior area has a jack-connecting portion positioned to removably receive the antenna jack such that the antenna can be snapped into and off of the hand-held electronic device between installed and removed positions, respectively. A rotation limiter is provided on the snap-on antenna to prevent the antenna from rotating past selected positions relative to the housing.

19 Claims, 3 Drawing Sheets

SNAP-ON ANTENNA AND PROTECTIVE CONNECTOR MOUNTING FOR A HAND-HELD ELECTRONIC DEVICE

TECHNICAL FIELD

The present invention is directed toward hand-held electronic devices, and more particularly toward hand-held electronic devices having antennas.

BACKGROUND OF THE INVENTION

Conventional hand-held electronic devices, such as hand-held computers, have been developed to communicate with other remotely located electronic devices via high frequency radio signals. These hand-held computers have antennas to receive and transmit the radio signals for increased efficiency in the communication. Most antennas are generally fixed to the housing of the hand-held computer such that the antennas are not rotatable. These fixed antennas have a limited degree of versatility and suffer from the risk of being broken or damaged during the life of the hand-held computer. Replacing the broken or damaged antenna or housing of the hand-held computer can be an expensive task that will take the hand-held computer out of productive use for a period of time.

Other hand-held computers or electronic devices include permanent antennas that are rotatable relative to the housing for movement between stored and active positions. The mechanical connection of these rotatable antennas to the housings will wear and may be damaged from improper rotation between their stored and active positions. Over time, the wear on the antenna components and other damage may damage the antenna and result in a failure of the antenna or the electrical and mechanical connection with the hand-held computer's housing. While reliable, long lasting antenna components are available, such components are expensive and not economically feasible.

Antennas on hand-held computers experience a further drawback in that the connection between an antenna and components within the computer is a relatively fragile connection. These fragile connections are susceptible to damage, particularly if the computer is jarred, inadvertently bumped, or dropped during day-to-day use. Fixing or replacing the permanent antenna's connection often requires a costly repair and removal of the hand-held computer from service for a period of time.

SUMMARY OF THE INVENTION

The present invention is directed toward a snap-on antenna and a protective connector mounting device for a hand-held electronic device that at least overcomes the drawbacks experienced in the prior art. In an exemplary embodiment of the present invention, the hand-held electronic device includes a housing having a sidewall with a jack-receiving aperture therein, an antenna jack extending through the jack-receiving aperture, and a flexible elastomeric bushing in the jack-receiving area between the antenna jack and the sidewall of the housing. The bushing substantially isolates the antenna jack from the sidewall so the antenna jack is deflectable relative to the housing's sidewall without damaging the antenna jack. The antenna jack and bushing are retained in the jack-receiving aperture by a retaining member that securely attaches to the antenna jack and retains the antenna jack in a selected position in the jack-receiving aperture.

The antenna of the exemplary embodiment is removably attachable to the antenna jack and rotatably movable relative to the housing between a raised, active position and a lowered, stored position. The antenna includes a substantially rigid base having an open interior area therein. The antenna's base is formed by two rigid shell portions fixedly joined together to define a body portion and a housing-attachment portion extending away from the body portion and terminating at an end surface. The housing-attachment portion has an aperture in the end surface that communicates with the open interior area. A plug connector is contained within the interior area of the base such that the base provides a protective shell around the plug connector. The plug connector has a jack-connecting portion adjacent to the aperture and adapted to removably receive a portion of the antenna jack therein such that the antenna can be plugged or snapped onto and off of the hand-held electronic device.

A seal is attached to the base's housing-attachment portion with the seal being positioned to sealably and frictionally engage the sidewall of the housing to form a seal therebetween when the antenna is in an installed position. The frictional engagement between the seal and the sidewall is sufficient to retain the antenna in a selective rotational position relative to the housing between the raised, active position, and the lowered, stored position. An active antenna portion having an antenna cable is attached to the plug connector and extends away from the rigid base. A flexible antenna sheath is attached at one end to the base and the sheath covers the active antenna portion to protect it from damage.

DETAILED DESCRIPTION OF THE INVENTION

Figure 1:
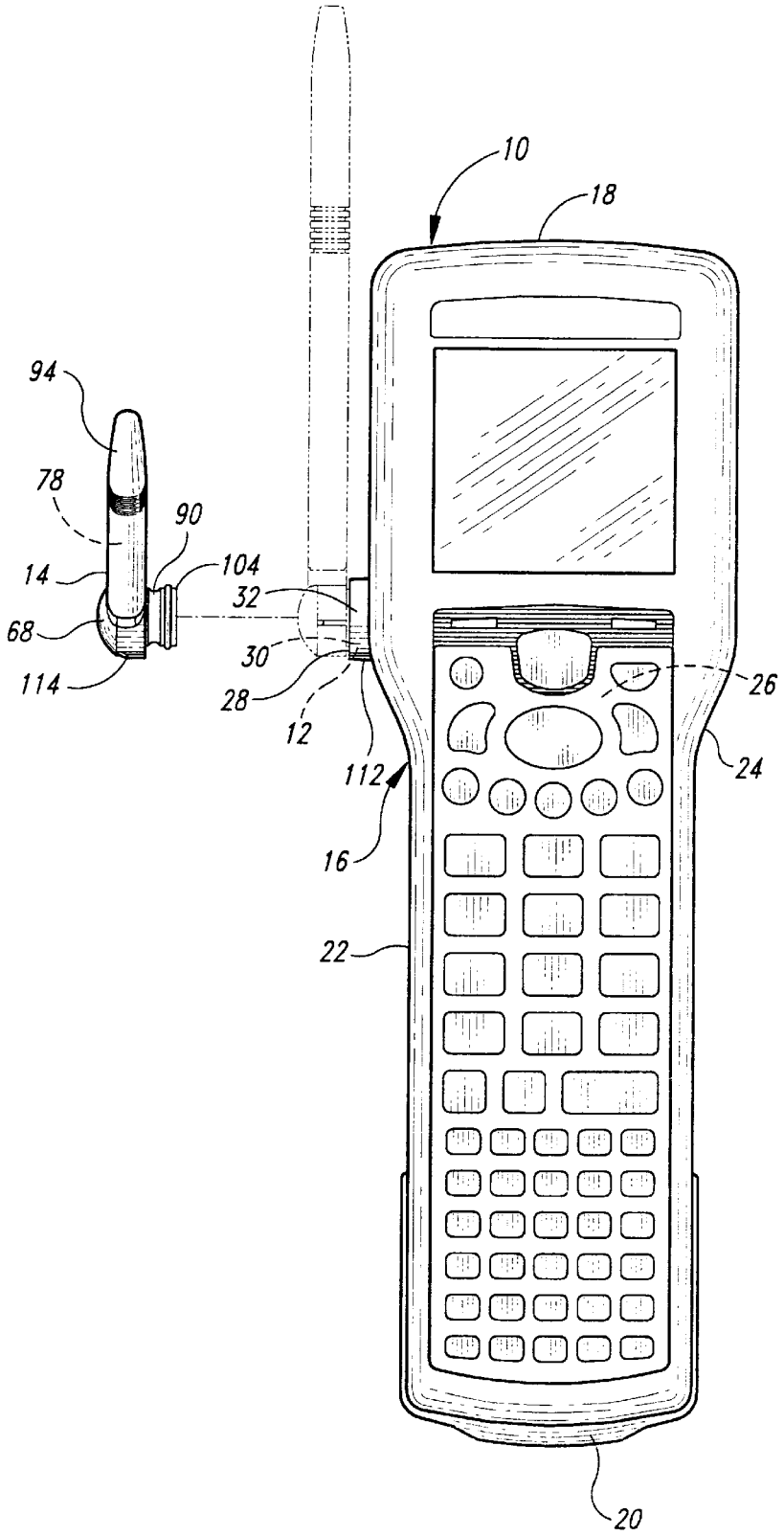
FIG. 1 is a partially exploded top isometric view of a hand-held computer and a snap-on antenna in accordance with the present invention, with the snap-on antenna being shown in solid line in a raised, active position and shown in phantom line in a lowered, stored position.

A portable, hand-held electronic device 10 having a connector mounting 12 and a snap-on antenna 14 in accordance with an exemplary embodiment of the invention is shown in the drawings for purposes of illustration. In the following description, numerous specific details are set forth such as specific components, arrangement and coupling of such components, etc., in order to provide a thorough understanding of the present invention. One skilled in the relevant art, however, will readily recognize that aspects of the present invention can be practiced without certain specific details, or with other components, coupling elements, etc. In other instances, well-known structures are not described in detail in order to avoid obscuring the present invention.

As best seen in FIG. 1, the portable hand-held electronic device 10, such as a hand-held computer and symbology reading or scanning device, has a housing 16 with a top end 18, a bottom end 20, a left sidewall 22 extending between the top and bottom ends, and a right sidewall 24 opposite the left sidewall. The housing 16 is shaped and sized to contain electronic components 26 therein, and the housing is preferably fabricated of a rigid plastic, such as abs-polycarbonate plastic or the like. A substantially cylindrical protective wall portion 28 is integrally connected to the left sidewall 22 and projects away from the left sidewall to define a protected, antenna-receiving area 30 within the protective wall portion.

Figure 2:
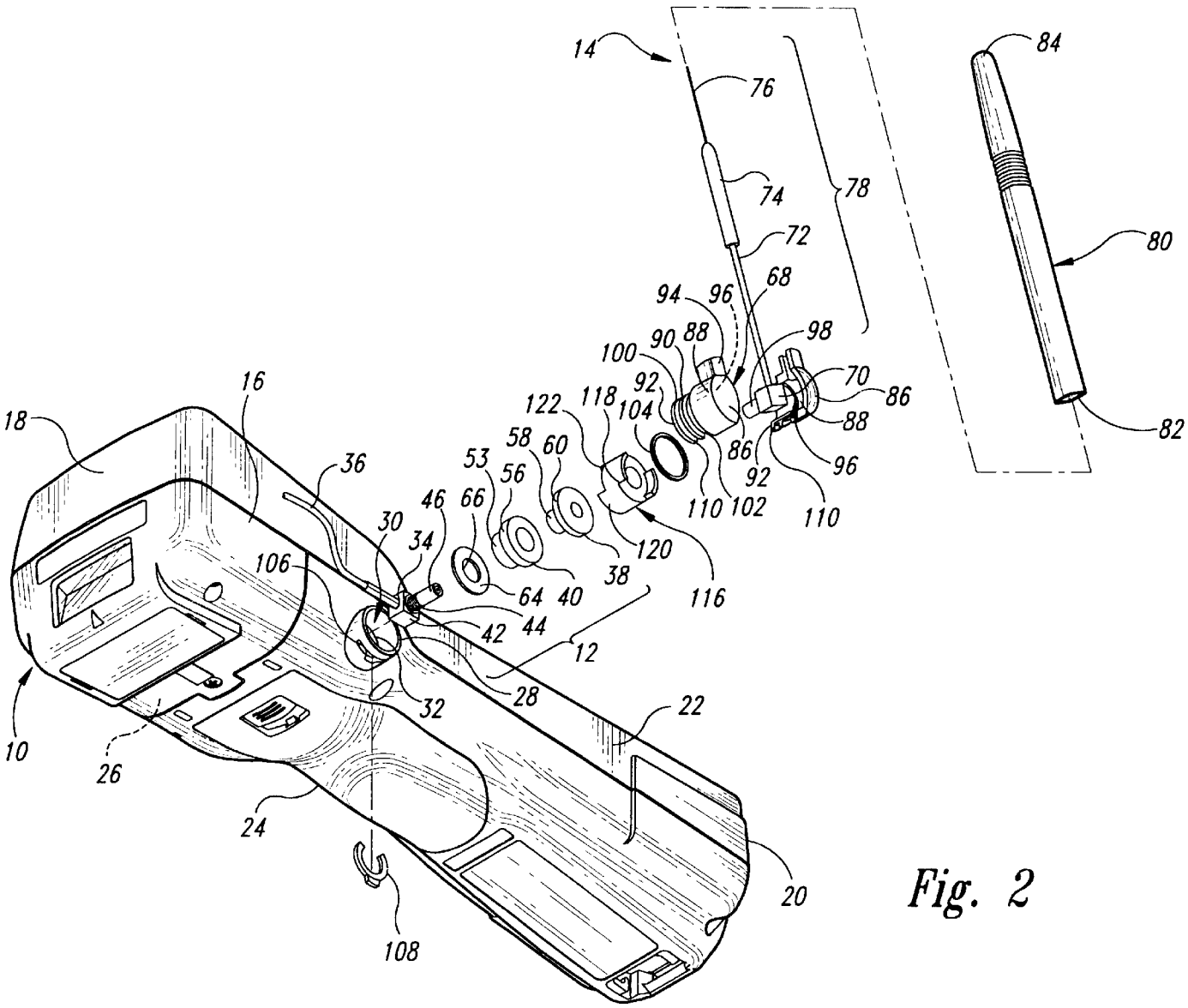
FIG. 2 is a fully exploded bottom isometric view of the hand-held computer and snap-on antenna of FIG. 1.

As best seen in FIG. 2, the antenna-receiving area 30 surrounds a jack-receiving aperture 32 extending through the left sidewall 22. The protective wall portion 28 is coaxially aligned with the jack-receiving aperture 32, and the jack-receiving aperture provides access to the interior of the housing 16 to allow for the snap-on antenna 14 to be operably interconnected to the electrical components 26 in the housing 16.

The connector mounting 12 includes a connecting jack 34, preferably an industry standard smb jack or other snap-fit electrical jack, mounted in the jack-receiving aperture 32. The connecting jack 34 is connected to a wire 36 that extends into the housing 16 and connects to the electronic components 26. The connecting jack 34 is adapted to releasably connect to the snap-on antenna 14 when the antenna is snapped into an installed position, shown in phantom line in FIG. 1, thereby electrically coupling the snap-on antenna 14 to the electrical components 26. As discussed in greater detail below, the connecting jack 34 is securely retained in the jack-receiving aperture 32 by a retaining sleeve 38 and flexible bushing 40 of the connector mounting 12. The bushing 40 isolates the connecting jack 34 from the left sidewall 22, such that the connecting jack may be deflected or otherwise slightly moved relative to the left sidewall. Accordingly, when the snap-on antenna 14 is in the installed position and is accidentally jarred or impacted, the connecting jack 34 can safely deflect without being damaged, thereby avoiding having to replace the connecting jack.

Figure 3:
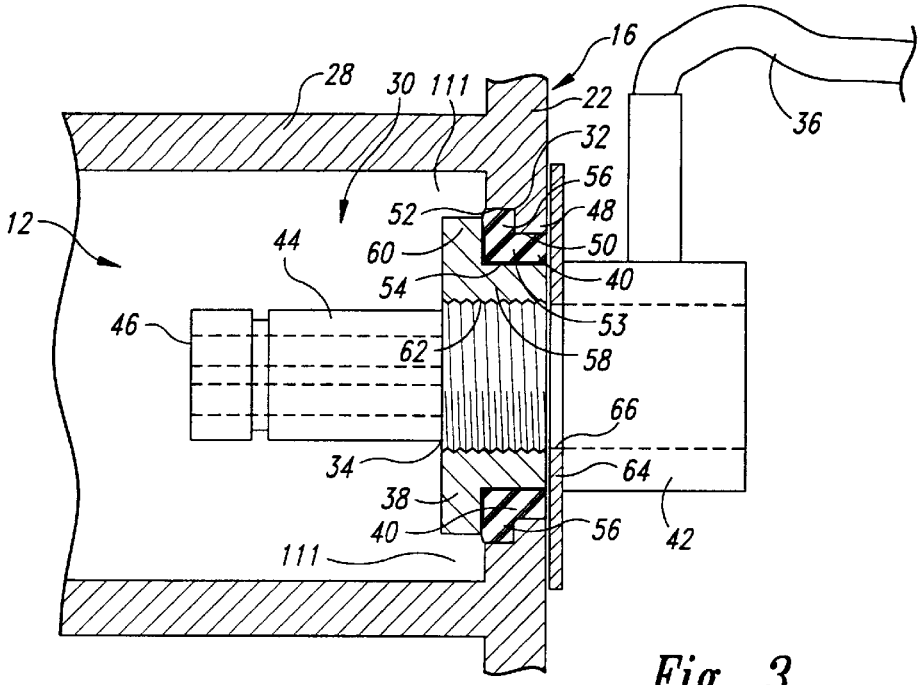
FIG. 3 is an enlarged cross-sectional view taken substantially along line 3—3 of FIG. 1, showing an antenna jack and flexible bushing mounted to a sidewall of the hand-held computer.

As best seen in FIGS. 2 and 3, the connecting jack 34 has a body portion 42 connected to the wire 36 and a threaded plug portion 44 extending away from the body portion. The connecting jack 34 is positioned in the jack-receiving aperture 32 with the threaded plug portion 44 extending through and being coaxially aligned with the jack-receiving aperture. The threaded plug portion 44 extends away from the body portion 42 and terminates at a plug end 46 that is within the protective antenna-receiving area 30. Accordingly, the protective wall portion 28 provides protection to the connecting jack's threaded plug portion 44 from being impacted when the snap-on antenna 14 is not installed.

As best seen in FIG. 3, the left sidewall 22 has a sidewall flange 48 that extends into the jack-receiving aperture 32 so that the jack-receiving aperture is formed by first and second annular sidewall portions 50 and 52, respectively. The first sidewall portion 50 has a first diameter defined by the sidewall flange 48, and the second sidewall portion 52 is adjacent to the sidewall flange 48 and has a second diameter that is greater than the first diameter. Accordingly, the jack-receiving aperture 32 has a step configuration therein.

The connecting jack 34 is mounted with the body portion 42 contained within the housing 16 adjacent to the left sidewall and the plug end 46 being on the opposite side of the left sidewall within the antenna-receiving area 30. The connecting jack 34 is securely retained in the jack-receiving aperture 32 by the retaining sleeve 38 and the bushing 40, each of which are also positioned in the jack-receiving aperture 32. The bushing 40 is mounted in the jack-receiving aperture 32 and in direct and sealing engagement with the first and second sidewall portions 50 and 52 of the jack-receiving aperture 32. The retaining sleeve 38 extends through the bushing 40 and the connecting jack's threaded plug portion 44 extends through the retaining sleeve, so the retaining sleeve and the threaded plug portion are not in direct engagement with the left sidewall 22.

In the exemplary embodiment, the bushing 40 is a rubber or polyurethane bushing that is compressible upon an exertion of a suitable force thereon. The bushing 40 has a body portion 53 with a bushing aperture 54 extending therethrough, and the bushing aperture is coaxially aligned with the jack-receiving aperture 32. An annular bushing flange 56 extends radially outwardly from the bushing's body portion 53 such that the bushing 40 has a generally T-shaped cross-sectional shape. The bushing flange 56 has an outer diameter that substantially corresponds to the second diameter of the jack-receiving aperture 32, and the bushing's body portion 53 has an outer diameter that substantially corresponds to the first diameter of the jack-receiving aperture. The bushing 40 is positioned within the jack-receiving aperture 32 such that the bushing flange 56 engages the second sidewall portion 52 and is parallel to and in direct engagement with the sidewall flange 48. The bushing body portion 53 is in direct engagement with the first sidewall portion 50 of the jack-receiving aperture 32. Accordingly, the bushing 40 sealably engages the left sidewall 22 around the jack-receiving aperture 32.

The retaining sleeve 38 has a substantially cylindrical sleeve body portion 58 extending through the bushing aperture 54, and a sleeve flange 60 extending radially outwardly from the sleeve body portion parallel to the bushing flange 56. The sleeve flange 60 has an outer diameter that substantially corresponds to the diameter of the bushing flange 56. The sleeve flange 60 directly engages the bushing flange 56, such that the bushing flange is sandwiched between the sleeve flange and the sidewall flange 48. Accordingly, the flexible bushing 40 completely isolates the retaining sleeve 38 from the housing's left sidewall 22.

The retaining sleeve 38 has a threaded aperture 62 extending therethrough and coaxially aligned with the jack-receiving aperture 32. The retaining sleeve 38 is removably screwed onto the threaded plug portion 44 with the threaded plug portion extending through the threaded sleeve, thereby retaining the connecting jack 34 within the jack-receiving aperture 32. A washer 64, preferably a rigid metal washer, is positioned adjacent to the left sidewall 22 and is sandwiched between the connecting jack's body portion 42 and the left sidewall. The washer 64 is also sandwiched between the connecting jack's body portion 42 and the body portions 53 and 58 of the flexible bushing 40 and the threaded retaining sleeve 38, respectively.

Accordingly, the retaining sleeve 38 screws onto the threaded plug portion 44 of the connecting jack 34 and securely retains the body portion 44 of the connecting jack in firm engagement with the washer 66. The flexible bushing 40 isolates the connecting jack 34 and the retaining sleeve 38 from the left sidewall 22. If the connecting jack 34 is impacted or otherwise moved relative to the left sidewall 22, the flexible bushing 40 will be compressed between the threaded sleeve 38 and the left sidewall, thereby allowing the connecting jack to deflect without being damaged. The flexible bushing 40 also provides a seal between the threaded sleeve 38 and the left sidewall 22 to prevent water, dust, or debris from passing through the jack-receiving aperture 32 into the housing 16 and contaminating the electrical components 26 (FIG. 1).

As best seen in FIG. 2, the snap-on antenna 14 has a substantially rigid base member 68 that substantially encases a plug connector 70 adapted to snap onto and off of the connecting jack 34. The plug connector 70 is electrically connected to a coaxial cable 72 that extends away from the plug connector and connects to a tubular aluminum member 74 at an end opposite the plug connector. An additional antenna wire 76 extends away from the tubular aluminum member 74 such that the antenna wire, the tubular member, and the coaxial cable 72 form an active antenna portion 78 adapted to receive and radiate selected signals at the selected frequencies. In the exemplary embodiment the tubular aluminum member 74 is crimped onto the coaxial cable 72 at one end, and the antenna wire 76 is conductively attached to the opposite end of the aluminum tubular member such that the tubular member is positioned between the antenna wire and the coaxial cable.

A flexible, elastomeric antenna sheath 80 extends over the active antenna portion 78 and protectively encases the active antenna portion. In the exemplary embodiment, the antenna sheath 80 is a polyurethane, overmolded sheath having an open bottom end 82 that is adhered to the antenna's base member 68. The antenna sheath 80 extends away from the base member 68 and terminates at a closed end 84 such that the active antenna portion 78 is fully encased and protected by the antenna sheath.

The base member 68 of the exemplary embodiment is formed by a pair of abs-polycarbonate shell portions 86 that are welded together or otherwise permanently affixed together so as to contain and protect the plug connector 70 therein. The two shell portions 68 form a partially spherical body portion 88 and a substantially cylindrical housing-attachment portion 90 projecting away from the body portion along a first axis. The housing-attachment portion 90 terminates at a substantially flat end surface 92 spaced apart from the body portion 88. The body portion 88 has a sheath attachment portion 94 projecting along a second axis that is substantially transverse to the first axis, such that the base portion has a generally L-shaped cross-sectional shape. The sheath attachment portion 94 is shaped and sized to extend partially into the open bottom end 82 of the antenna sheath 80, and the antenna sheath is permanently adhered to the exterior of the sheath attachment portion.

The pair of shell portions 86 are shaped and sized to define an open interior area 96 within the base member 68. The housing-attachment portion 90 has an aperture in the flat end surface 92 that communicates with the open interior area 96 and is coaxially aligned with the first axis. The sheath attachment portion 94 also has an aperture therein that communicates with the interior area 96 and is coaxially aligned with the second axis. The coaxial cable 72 of the active antenna portion 78 extends through the aperture in the sheath attachment portion 94 and connects to the plug connector 70, thereby operatively interconnecting the active antenna portion to the plug connector 70.

The plug connector 70 of the exemplary embodiment is an smb connector having a substantially cylindrical jack-receiving portion 98 that is contained within the interior area 96 and that is coaxially aligned with the first axis and the aperture in the housing-attachment portion's end surface 92. The jack-receiving portion 98 terminates at an opening that is generally coplanar with the end surface 92. The jack-receiving portion 98 is shaped and sized to releasably receive the threaded plug portion 44 of the connecting jack 34 such that the snap-on antenna 14 will snap onto and off of the connecting jack to operatively connect and disconnect the snap-on antenna from the electrical components 26 within the housing 16. Accordingly, the snap-on antenna 14 connects to the connecting jack 34 when moved to the installed position, and the antenna disconnects from the connecting jack when the snap-on antenna is moved to the removed position.

The housing-attachment portion 90 has a substantially cylindrical shape with an outer diameter that is slightly smaller than the inner diameter of the protective wall portion 28 on the housing's left sidewall 22. Accordingly, the snap-on antenna 14 can be moved to the installed position with an minimal degree of interference by the protective wall portion 28 as the antenna snaps into the installed position. When the snap-on antenna 14 is in the installed position, the housing-attachment portion 90 extends into the antenna-receiving area 30 and the plug connector 70 is plugged onto the connecting jack's threaded portion 44.

In the exemplary embodiment, the housing-attachment portion 90 has first and second annular grooves 100 and 102 formed therein, with the first groove 100 being closer to the end surface 92 and the second groove being closer to the base member's body portion 88. The first groove 100 removably receives a rubber O-ring 104 having an outer diameter that is slightly larger than the inner diameter of the protective wall portion 28. When the snap-on antenna 14 is moved to the installed position, the rubber O-ring 104 is pressed into firm engagement between the protective wall portion 28 and the antenna's housing-attachment portion 90 to form a seal therebetween. The seal is sufficient to prevent water, dust, or debris from passing between the protective wall portion 28 and the antenna's housing-attachment portion 90 and through the jack-receiving aperture 32 of the housing 16.

When the snap-on antenna 14 is in the installed position, it is rotatable about the first axis and about the threaded plug portion 44 to a selected angular position relative to the housing 16. The O-ring 104 frictionally engages the protective wall portion 28 and retains the snap-on antenna 14 in the selected angular position. Accordingly, the snap-on antenna 14 is movable to the selected angular position and the frictional engagement provided by the O-ring 104 holds the snap-on antenna in place. The frictional engagement is overcome by a user grasping and rotating the snap-on antenna 14, although the frictional engagement is sufficient to prevent gravity alone from rotating the snap-on antenna relative to the housing 16.

As best seen in FIG. 2, an elongated slot 106 extends through the protective wall portion 28 along its bottom side. The elongated slot 106 is positioned to align with the second groove 102 on the antenna's housing-attachment portion 90 when the snap-on antenna 14 is in the installed position. The elongated slot 106 removably receives a retaining ring 108 therethrough that snaps into the second groove 102. The retaining ring 108 engages the housing-attachment portion 90 with part of the retaining ring extending through the elongated slot 106, thereby locking the snap-on antenna 14 in the installed position while allowing the antenna to rotate relative to the housing 16. When the snap-on antenna 14 is to be removed from the housing 16, the retaining ring 108 is disengaged from the antenna's housing-attachment portion 90, withdrawn from the elongated slot 106, and the snap-on antenna is moved axially along the first axis out of engagement with the connecting jack 34.

In the exemplary embodiment, the frictional engagement between the O-ring 104 and the protective wall portion 28 is sufficient to retain the snap-on antenna 14 in the installed position, and the retaining ring 108 is installed as a safety measure to prevent inadvertent removal of the snap-on antenna during operation of the hand-held electronic device 10. In an alternate embodiment, the retaining ring 108 is not used and two O-rings are positioned in the first and second grooves 100 and 102 to securely and sealably retain the antenna 14 in the installed position.

In another alternate embodiment of the present invention, the O-ring 104 is retained within the second groove 102, and the elongated slot 106 is positioned within the protective wall portion 28 to align with the first groove 100. In this alternate embodiment, the O-ring 104 provides the frictional engagement to retain the snap-on antenna 14 in the selected angular orientation relative to the housing 16. The elongated slot 106 is positioned between the O-ring 14 and the jack-receiving aperture 32, which reduces the effect of the seal formed between the O-ring and the protective wall portion 28. In this alternate embodiment, however, the seal formed between the rubber bushing 40 and the left sidewall 22, as discussed in detail above, prevents water, dust, or other debris from passing through the jack-receiving aperture 32 and contaminating the electrical components 26 within the housing 16.

In the exemplary embodiment, the housing-attachment portion 90 has an annular ring 110 extending around and projecting from the flat end surface 92 such that the flat end surface is slightly recessed within the annular ring. When the snap-on antenna 14 is in the installed position, the flat end surface 92 is pressed into engagement with the threaded retaining sleeve 38, and the annular ring 110 is positioned in an annular space 111 (FIG. 3) provided between the sleeve flange 60 of the retaining sleeve and the protective wall portion 28. Accordingly, the antenna's base portion 68, the plug connector 70, the annular ring 110, and the O-ring 104 substantially fill the entire antenna-receiving area 30 defined by the protective wall portion 28 when the snap-on antenna 14 is in the installed position. The protective wall portion 28 also helps prevent the snap-on antenna 14 from moving in a direction transverse to the first axis when in the installed position.

Figure 4:
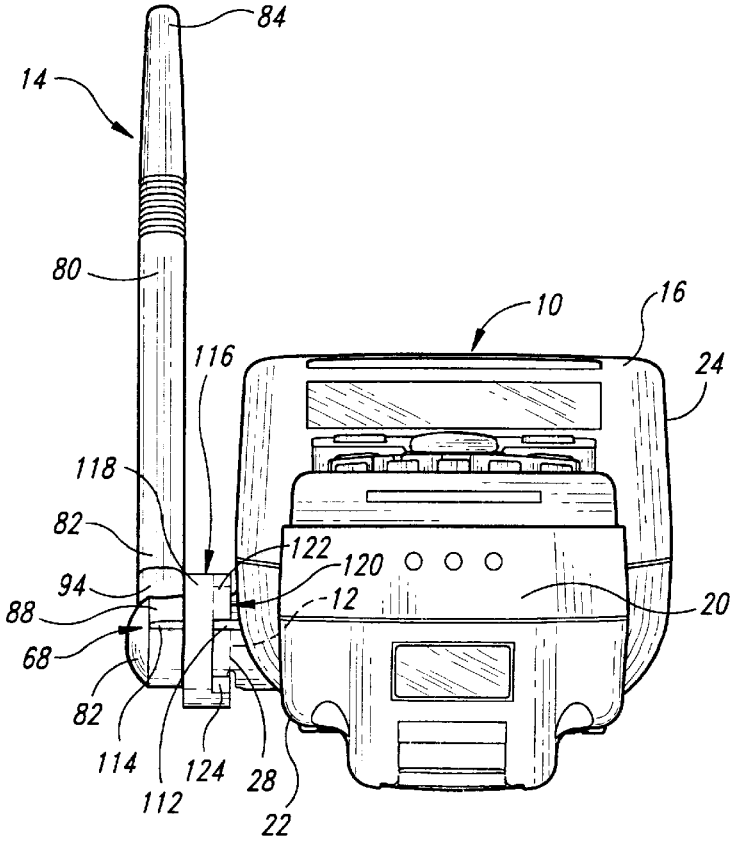
FIG. 4 is an enlarged rear elevation view of the hand-held computer and snap-on antenna of FIG. 1, with the snap-on antenna including a rotation limiting device, and the antenna being shown in solid line in the raised, active position, and shown in phantom line in the lowered, stored position.

As indicated above, the snap-on antenna 14 is rotatable relative to the housing 16 between the raised, active position, shown in solid line in FIGS. 1 and 4, and the lowered, stored position shown in phantom line. The angular rotation between the lowered, stored position and the raised, active position is within the range of approximately 0 to 70 degrees, inclusive, with the snap-on antenna 14 being at 0 degrees when in the lowered, stored position and at 70 degrees when in the raised, active position. This angular rotation of approximately 70 degrees for the exemplary embodiment is such that when a user is holding the hand-held electronic device 10 at approximately a 20 degree angle from horizontal in an ergonomically comfortable position, the snap-on antenna is substantially vertical when in the raised, active position. In alternate embodiments, the angular rotation range for the antenna 14 for different hand-held electronic devices 10 is selected so the antenna is vertical in the raised, active position when users hold the devices in an operating position.

As best seen in FIGS. 1 and 4, a first position-indicating tab 112 is integrally attached to or formed on the exterior of the protective wall portion 28, and a second position-indicating tab 114 is integrally connected to or formed on the body portion 88 of the antenna's base 68. The second position-indicating tab 114 is positioned to align with the first position-indicating tab 112 when the snap-on antenna 14 is in the raised, active position. When the snap-on antenna 14 is moved away from the raised, active position, the second position-indicating tab 114 is no longer aligned with the first position-indicating tab 112 on the housing, thereby indicating the snap-on antenna is not in the raised, active position. Accordingly, a user can easily identify when the snap-on antenna 14, in the installed position, has been fully moved to the raised, active position by simply looking at the first and second position-indicating tabs 112 and 114.

As best seen in FIGS. 2 and 4, the exemplary embodiment of the invention includes a rotation limiter 116 fixedly attached to the housing-attachment portion 90 of the antenna's base portion 68. The rotation limiter 116 prevents the snap-on antenna 14 from rotating past 0 degrees and past 70 degrees. The rotation limiter 116 in alternate embodiments is shaped and sized to allow the snap-on antenna 14 to rotate within a different range of angular orientations relative to the housing, such as 0 to 180 degrees, inclusive.

The rotation limiter 116 in the illustrated embodiment includes a generally cylindrical mounting portion 118 affixed to the housing-attachment portion 90, and a pair of spaced-apart upper and lower limiter flanges 120 and 122 project outwardly away from the mounting portion substantially parallel with the first axis that extends through the housing-attachment portion. The upper and lower limiter flanges 120 and 122 are arcuate shaped members that extend around the exterior of the protective wall portion 28 when the snap-on antenna 14 is in the installed position.

As the snap-on antenna 14 is rotated about the first axis relative to the housing 16, the upper and lower limiter flanges 120 and 122 move around the exterior of the protective wall portion 28, and the housing-attachment portion 90 rotates within the antenna-receiving area 30. When the snap-on antenna 14 is moved from the raised, active position to the lowered, stored position, the lower limiter flange 122 abuts against the position-indicating tab 112, which projects outwardly from the protective wall portion 28, thereby preventing the snap-on antenna from moving past the lowered, stored position. Accordingly, the position-indicating tab 112 is also a rotation-limiting tab.

The upper limiter flange 120 is shaped and sized to allow the snap-on antenna 14 to rotate to the lowered, stored position, and to prevent the snap-on antenna from moving past the raised, active position. When the snap-on antenna 14 is in the raised, active position, the upper limiter flange 120 abuts the position-indicating tab 112 and prevents further rotation of the snap-on antenna past 70 degrees. In an alternate embodiment, a separate rotation-limiting tab is provided on the housing 16 at a position that blocks the upper and lower limiter flanges 120 and 122 from moving past selected positions relative to the housing. In another alternate embodiment, two separate rotation-limiting tabs are provided on the housing for each of the upper and lower limiter tabs 120 and 122 to selectively limit rotation of the snap-on antenna 14 when in the installed position.

In yet another alternate embodiment of the present invention, the snap-on antenna 14 does not include the rotation limiter 116, so the snap-on antenna is fully rotatable relative to the housing 16 through a range of 360 degrees to any angular position relative to the housing. While full 360 degrees rotation of the snap-on antenna 14 may result in greater wear of the antenna over the life of the hand-held electronic device 10, the snap-on antenna is adapted to be easily and quickly removed from the housing 16 and replaced. One snap-on antenna 14 can also be easily and quickly replaced, for example, with another selected snap-on antenna having different electronic characteristics. Such quick replacement of the snap-on antenna 14 allows the hand-held electronic device 10 to stay in service without down time for antenna repair.

Although specific embodiments of, and examples for, the present invention have been described above for purposes of illustration, various modifications can be made without departing from the spirit and scope of the invention, as will be evident by those skilled in the relevant art. For example, the hand-held electronic device can be a computer, radio, cellular telephone, or other device. The teachings provided herein of the present invention can be applied to other snap-on antenna and protective connector mountings, not necessarily those limited to hand-held computers.

Furthermore, while the present invention is generally described as being applied to the housing of a hand-held electronic device, the principles of the present invention can be applied to other devices for providing a snap-on antenna and protective connector mounting. These and other changes can be made to the invention in light of the above detailed description. In general, in the following claims, the terms used should not be construed to limit the invention to the specific embodiments disclosed in the specification and the claims, but should be construed to include all snap-on antennas and protective connector mountings in accordance with the claims. Accordingly, the invention is not limited by the disclosure, but instead its scope is to be determined entirely from the following claims.

We claim:

1. A hand-held electronic device having electrical components therein, comprising:

a housing having a jack-receiving aperture therein;

an antenna jack extending through the jack-receiving aperture;

a wire connected to the antenna jack and being attachable to the electrical components;

a flexible bushing positioned in the jack-receiving aperture between the antenna jack and the housing, the flexible bushing substantially isolating the antenna jack from the housing so the antenna jack is deflectable relative to the housing without damaging the antenna jack; and an antenna removably attached to the antenna jack and being movable between an installed position and a removed position, the antenna being conductively attached to the antenna jack when in the installed position and being out of engagement with the antenna jack when in the removed position, the antenna being rotatable about the antenna jack relative to the housing to a selected angular position, the antenna having:

a substantially rigid base having an open interior area therein and having a housing-attachment portion with a first aperture therein communicating with the open interior area, and the base having a second aperture therein communicating with the interior area, the housing-attachment portion being adjacent to the antenna jack when the antenna is in the installed position;

a plug connector contained in the interior area of the base, the plug connector having a jack-connecting portion adjacent to the first aperture, the jack-connecting portion being releasably connected to the antenna jack when the antenna is in the installed position;

an active antenna portion attached to the plug connector and extending through the second aperture in the base and away from the base, the active antenna portion being conductively connected to the wire by the plug connector and the antenna jack when the antenna is in the installed position; and a flexible antenna sheath extending over the active antenna portion.

2. The hand-held electronic device of claim 1, further including a seal positioned between the housing-attachment portion and the housing adjacent to the jack-receiving aperture when the antenna is in the installed position.

3. The hand-held electronic device of claim 2 wherein the seal frictionally engages the housing and releasably retains the antenna in a selected position.

4. The hand-held electronic device of claim 2 wherein the seal is attached to the housing-attachment portion of the base.

5. The hand-held electronic device of claim 1 wherein the antenna is rotatable through a range of 0 to 70 degrees, inclusive, relative to the housing.

6. The hand-held electronic device of claim 1 wherein the housing has first position indicia thereon, and the base of the antenna has second position indicia thereon that is alignable with the first position indicia when the antenna is in the installed position.

7. The hand-held electronic device of claim 1 wherein the base of the antenna includes two rigid base portions fixedly connected together to surround the plug connector.

8. The hand-held electronic device of claim 1 wherein the antenna is rotatable about the antenna jack when in the installed position, the hand-held electronic device further including a rotation limiting member that engages the housing and prevents the antenna from rotating past a selected position relative to the housing.

9. The hand-held electronic device of claim 1 wherein the housing has a sidewall with the jack-receiving aperture extending through the sidewall, and a rigid, cylindrical wall portion extends around the jack-receiving aperture and projects away from the sidewall to define a protected antenna-receiving area therein sized to receive the housing-attachment portion of the antenna's base, a portion of the antenna jack extending into and terminating in the antenna-receiving area.

10. A hand-held electronic device having electrical components therein, comprising:

a housing having a jack-receiving aperture therein;

an antenna jack extending through the jack-receiving aperture;

a wire connected to the antenna jack and being attachable to the electrical components;

a flexible bushing positioned in the jack-receiving aperture between the antenna jack and the housing, the flexible bushing substantially isolating the antenna jack from the housing so the antenna jack is deflectable relative to the housing without damaging the antenna jack;

an antenna removably attached to the antenna jack and being movable between an installed position and a removed position, the antenna being conductively attached to the antenna jack when in the installed position and being out of engagement with the antenna jack when in the removed position, the antenna being rotatable about the antenna jack relative to the housing to a selected angular position, the antenna having;

a substantially rigid base having an open interior area therein and having a housing-attachment portion with a first aperture therein communicating with the open interior area, and the base having a second aperture therein communicating with the interior area, the housing-attachment portion being adjacent to the antenna jack when the antenna is in the installed position;

a plug connector contained in the interior area of the base, the plug connector having a jack-connecting portion adjacent to the first aperture, the jack-connecting portion being releasably connected to the antenna jack when the antenna is in the installed position;

an active antenna portion attached to the plug connector and extending through the second aperture in the base and away from the base, the active antenna portion being conductively connected to the wire by the plug connector and the antenna jack when the antenna is in the installed position;

a flexible antenna sheath extending over the active antenna portion; and a retaining member attached to the antenna jack and securely holding the antenna jack on the housing.

11. The hand-held electronic device of claim 10 wherein the housing-attachment portion has an end surface and an annular ring portion extending around the end surface so the end surface is recessed, the annular ring portion extending around a portion of the retaining member when the antenna is in the installed position.

12. A hand-held electronic device having electrical components therein, comprising:

a housing having a jack-receiving aperture therein;

an antenna jack extending through the jack-receiving aperture;

a wire connected to the antenna jack and being attachable to the electrical components;

a flexible bushing positioned in the jack-receiving aperture between the antenna jack and the housing, the flexible bushing substantially isolating the antenna jack from the housing so the antenna jack is deflectable relative to the housing without damaging the antenna jack;

an antenna removably attached to the antenna jack and being movable between an installed position and a removed position, the antenna being conductively attached to the antenna jack when in the installed position and being out of engagement with the antenna jack when in the removed position, the antenna being rotatable about the antenna jack relative to the housing to a selected angular position, the antenna having;

a substantially rigid base having an open interior area therein and having a housing-attachment portion with a first aperture therein communicating with the open interior area, and the base having a second aperture therein communicating with the interior area, the housing-attachment portion being adjacent to the antenna jack when the antenna is in the installed position;

a plug connector contained in the interior area of the base, the plug connector having a jack-connecting portion adjacent to the first aperture, the jack-connecting portion being releasably connected to the antenna jack when the antenna is in the installed position;

an active antenna portion attached to the plug connector and extending through the second aperture in the base and away from the base, the active antenna portion being conductively connected to the wire by the plug connector and the antenna jack when the antenna is in the installed position;

a flexible antenna sheath extending over the active antenna portion; and a retaining member attached to the antenna jack the retaining member sandwiches a portion of the bushing between the retaining member and the housing, with the retaining member being out of direct engagement with the housing.

13. An antenna usable with an electronic device having a housing, comprising:

a substantially rigid base having a housing-attachment portion with a first aperture therein, and the base having a second aperture therein, the housing-attachment portion being positionable adjacent to an antenna jack of the electronic device when the antenna is in an installed position on the electronic device wherein the antenna is rotatable relative to the housing when in the installed position;

a plug connector connected to the base, the plug connector having a jack-connecting portion adjacent to the first aperture and positioned to releasably receive a portion of the antenna jack therein when the antenna is moved to the installed position and electrically coupling the antenna to the electronic device;

an active antenna portion attached to the plug connector and extending through the second aperture in the base and away from the base; and a rotation limiter attached to the base and positioned to engage the housing to prevent the antenna from rotating past a selected angular position.

14. The antenna of claim 13 wherein the rotation limiter is sized to allow the antenna to rotate through a range of 0 to 70 degrees, inclusive, relative to the housing when in the installed position.

15. An antenna usable with an electronic device having a housing, comprising:

a substantially rigid base having a housing-attachment portion with a first aperture therein, and the base having a second aperture therein, the housing-attachment portion being positionable adjacent to an antenna jack of the electronic device when the antenna is in an installed position on the electronic device;

a plug connector connected to the base, the plug connector having a jack-connecting portion adjacent to the first aperture and positioned to releasably receive a portion of the antenna jack therein when the antenna is moved to the installed position and electrically coupling the antenna to the electronic device;

an active antenna portion attached to the plug connector and extending through the second aperture in the base and away from the base; and a position indicator attached to the base, the position indicator being adapted to indicate the angular position of the antenna relative to the housing.

16. A hand-held electronic device usable with a snap-on antenna comprising:

a housing having a sidewall with a jack-receiving aperture therein;

an antenna wire coupled to the housing;

an antenna jack attached to the antenna wire and extending through the jack-receiving aperture, the antenna jack being connectable to the antenna;

a flexible bushing mounted in the jack-receiving aperture between the antenna jack and the sidewall and isolating the antenna jack from the sidewall, the bushing being compressible and the antenna jack being deflectable relative to the sidewall to compress the bushing without damaging the antenna jack; and a retaining member attached to the antenna jack and securely holding the antenna jack on the housing.

17. A hand-held electronic device usable with a snap-on antenna comprising:

a housing having a sidewall with a jack-receiving aperture therein;

an antenna wire coupled to the housing;

an antenna jack attached to the antenna wire and extending through the jack-receiving aperture, the antenna jack being connectable to the antenna;

a flexible bushing mounted in the jack-receiving aperture between the antenna jack and the sidewall and isolating the antenna jack from the sidewall, the bushing being compressible and the antenna jack being deflectable relative to the sidewall to compress the bushing without damaging the antenna jack, wherein the sidewall has a sidewall flange extending into the jack-receiving aperture, and the bushing has a bushing flange in direct engagement with the sidewall flange.

18. The hand-held electronic device of claim 17, further including a retaining member attached to the antenna jack and sandwiching the bushing flange between the retaining member and the sidewall flange, the retaining member being out of direct engagement with the sidewall.

19. A hand-held electronic device, comprising:

a housing having a sidewall with a jack-receiving aperture therein and having a rigid, cylindrical protective wall portion integrally connected to the sidewall and projecting away from the sidewall to define a protected antenna-receiving area, the protective wall portion being substantially coaxially aligned with the jack-receiving aperture and having an elongated slot extending therethrough and communicating with the antenna-receiving area, the sidewall having a sidewall flange extending into the jack-receiving aperture so the jack-receiving aperture has a first sidewall portion with a first diameter defined by the sidewall flange and a second sidewall portion adjacent to the sidewall flange with a second diameter, the second diameter being greater than the first diameter;

an smb jack having a body portion and a threaded plug portion extending away from the body portion, the smb jack being substantially coaxially aligned with the jack-receiving aperture, the threaded plug portion extending through the jack-receiving aperture and terminating at one end within the antenna-receiving area, and the body portion being substantially adjacent to the sidewall flange at the jack-receiving aperture;

a wire conductively connected to the smb jack and extending into the housing;

a stainless steel washer sandwiched between the body portion of the smb jack and the sidewall of the housing, the washer having a washer aperture coaxially aligned with the jack-receiving area, and the threaded plug portion extends through the washer aperture, the washer being in direct engagement with the sidewall to distribute forces to the sidewall;

a flexible rubber bushing mounted in the jack-receiving aperture, the rubber bushing having a bushing aperture coaxially aligned with the jack-receiving aperture and having a bushing flange portion with an outer diameter substantially corresponding to the second diameter of the jack-receiving aperture, the bushing flange being substantially parallel to and in direct engagement with the sidewall flange;

a threaded sleeve removably screwed onto the threaded plug portion with the threaded plug portion extending through the threaded sleeve with the threaded sleeve retaining the smb jack in the jack-receiving aperture, the threaded sleeve being coaxially aligned with the jack-receiving aperture and having a first cylindrical portion extending through the bushing aperture and the jack-receiving aperture and engaging the stainless steel washer, the threaded sleeve having an annular sleeve flange portion attached to the first cylindrical portion and engaging the bushing flange with the bushing flange being sandwiched between the sleeve flange and the sidewall flange, the threaded sleeve is adapted to retain the body portion of the smb jack in firm engagement with the washer, the threaded sleeve directly engaging the rubber bushing and being out of direct engagement with the sidewall so the smb jack is movably deflectable relative to the sidewall thereby causing the threaded sleeve to compress the rubber bushing without the smb jack being damaged by the deflecting movement;

a stop member projecting outwardly from the housing adjacent to the protective wall portion;

a first position-indicating member projecting from the protective wall portion;

an antenna removably mountable to the smb jack and being movable between an installed position and a removed position, the antenna being retained partially within the antenna-receiving area when in the installed position and being out of engagement with the smb jack when in the removed position, the antenna being rotatable relative to the housing through a range of 0 to 70 degrees relative to the housing, the antenna having:

an abs-polycarbonate base member defined by two shell portions welded together, the shell member having a body portion, a substantially cylindrical housing-attachment portion projecting from the body portion along a first axis and terminating at a substantially flat end surface, and a sheath attachment portion projecting away from the body portion along a second axis that is substantially transverse to the first axis, the two shell portions being shaped to define an open interior area therein, the housing-attachment portion having a first aperture therein communicating with the open interior area and being coaxially aligned with the first axis, and the sheath attachment portion having a second aperture therein communicating with the interior area and being coaxially aligned with the second axis, the housing-attachment portion having first and second annular grooves spaced apart from each other and coaxially aligned with the first axis, the housing-attachment portion being positioned in the antenna-receiving area with the first axis coaxially aligned with the threaded plug portion of the smb jack, and the end surface of the housing-attachment portion engages the threaded sleeve, the substantially cylindrical housing-attachment portion having an annular ring portion extending around the end surface so the end surface is recessed, and the ring portion extends around the threaded sleeve and the end surface is pressed into engagement with the threaded sleeve when the antenna is in the installed position;

a coaxial cable having first and second ends, the first end extending into the second aperture of the sheath attachment portion of the shell member, and the second end of the coaxial cable being spaced apart from the shell member;

an aluminum tubular member crimped onto the second end of the coaxial cable, the aluminum tubular member and the coaxial cable being an active portion of the antenna;

a flexible elastomeric, polyurethane sheath extending over the active portion of the antenna and being adhesively attached at one end to the sheath attachment portion of shell member, the sheath protectively encasing the active portion of the antenna; and an smb plug connector fixedly contained in the interior area of the shell member, the smb plug connector being conductively connected to the first end of the coaxial cable and having a jack-receiving portion within and coaxially aligned with the second aperture, the jack-receiving portion removably receiving the threaded plug portion of the smb jack therein to conductively connect the wire to the active portion of the antenna, the connector terminating at a jack-receiving opening at the end surface of the shell member's housing-attachment portion so the jack-receiving opening is recessed relative to the annular ring portion;

an elastomeric O-ring seal removably retained in the first annular groove in the housing-attachment portion, the O-ring being in sealable and frictional engagement with the protective wall portion of the housing to form a seal therebetween when the antenna is in the installed position, the frictional engagement being sufficient to retain the antenna in a selected rotational position relative to the housing;

a retaining ring removably retained in the second annular groove and positioned to removably lock the antenna in the installed position, the retaining ring being shaped and sized so a portion of the retaining ring extends through the slot in the protective wall portion of the housing when the antenna is in the installed position;

a rotation limiting member attached to the shell member and positioned to engage the stop on the housing to prevent the antenna from rotating past the range of 0 to 70 degrees; and a second position-indicating member projecting from the body portion of the shell member and positioned to align with the first position-indicating member when the antenna is rotated to 70 degrees relative to the housing.

* * * * *